US008668628B2

(12) United States Patent
Wang

(10) Patent No.: US 8,668,628 B2
(45) Date of Patent: Mar. 11, 2014

(54) ELECTRIC TREADMILL WITH A FOLDING MECHANISM BY USE OF TWO SWIVEL PIECES

(76) Inventor: Leao Wang, Taiping (TW)

( * ) Notice: Subject to any disclaimer, the term of this patent is extended or adjusted under 35 U.S.C. 154(b) by 709 days.

(21) Appl. No.: 12/941,951

(22) Filed: Nov. 8, 2010

(65) Prior Publication Data

US 2012/0115686 A1 May 10, 2012

(51) Int. Cl.
*A63B 22/02* (2006.01)

(52) U.S. Cl.
USPC ..... 482/54

(58) Field of Classification Search
USPC ..... 482/51, 54
See application file for complete search history.

(56) References Cited

U.S. PATENT DOCUMENTS

2009/0093347 A1* 4/2009 Wang ..... 482/54
2009/0111665 A1* 4/2009 Wang ..... 482/54
2009/0124465 A1* 5/2009 Wang ..... 482/54
2009/0163326 A1* 6/2009 Wang ..... 482/54
2009/0176627 A1* 7/2009 Wang ..... 482/54
2009/0239716 A1* 9/2009 Wang ..... 482/54
2011/0306472 A1* 12/2011 Wang ..... 482/54
2012/0129654 A1* 5/2012 Wang ..... 482/4
2013/0203560 A1* 8/2013 Wang ..... 482/54

* cited by examiner

*Primary Examiner* — Oren Ginsberg

(57) ABSTRACT

An electric treadmill with a folding mechanism by use of two swivel pieces includes a handrail frame mounted at both sides of the front end of the base frame. A base frame swivel piece is pivotally positioned at both sides near the front part of the bottom of the base frame, respectively. A handrail frame swivel piece is pivotally disposed near the bottom of the handrail frames, respectively. A pull rod is pivotally interposed between the swivel pieces. A movable support with ground-touching rollers is pivotally coupled to a cross shaft of the base frame swivel pieces. Moreover, the movable support is constantly biased by a telescopic supporting element. In this way, an action bar of the telescopic supporting element pushes the movable support forward when the base frame is folded upwards. Meanwhile, the ground-touching rollers are constantly in contact with the ground. Accordingly, a stable folded-up position is achieved.

2 Claims, 5 Drawing Sheets

ELECTRIC TREADMILL WITH A FOLDING MECHANISM BY USE OF TWO SWIVEL PIECES

BACKGROUND OF THE INVENTION

1. Fields of the Invention

The invention relates to an electric treadmill with a folding mechanism by use of two swivel pieces, and more particularly, to a treadmill that permits a stable support in a folded-up position. Moreover, the entire volume of the treadmill in the folded-up position is effectively reduced.

2. Description of the Related Art

This application is a continuation-in-part of application Ser. No. 12/815,409 titled "electric treadmill with a folding mechanism by use of a swivel piece". According to the prior art, the supporting assembly has to be mounted near the middle portion of the base frame for maintaining the folding and supporting stability. Moreover, the folding peak of the base frame is not at an optimal folding angle perpendicular to the ground. Therefore, the entire volume of the treadmill in a folded position can't be effectively and considerably reduced. Moreover, people tend to worry about the fact that the base frame folded in an inclined position may fall down in an unexpected way, thereby affecting the safety. Thus, a further improvement is required.

SUMMARY OF THE INVENTION

An object of the invention is to provide an electric treadmill with a folding mechanism that employs two swivel pieces such that the folded-up assembly is concentrated possibly toward the front end of the base frame for considerably reducing the entire volume in the folded-up position. Meanwhile, the folding peak of the base frame is at an optimal folding angle perpendicular to the ground. Therefore, the concerns about safety may be eliminated. In addition, the support stability of the base frame is increased.

According to the invention, an electric treadmill with a folding mechanism by use of two swivel pieces includes a handrail frame mounted at both sides of the front end of the base frame. A base frame swivel piece is pivotally positioned at both sides near the front part of the bottom of the base frame, respectively. A handrail frame swivel piece is pivotally disposed near the bottom of the handrail frames, respectively. A pull rod is pivotally interposed between the swivel pieces. A movable support with ground-touching rollers is pivotally coupled to a cross shaft of the base frame swivel pieces. Moreover, the movable support is constantly biased by a telescopic supporting element. In this way, an action bar of the telescopic supporting element pushes the movable support forward when the base frame is folded upwards. Meanwhile, the ground-touching rollers are constantly in contact with the ground. Accordingly, a stable folded-up position is achieved.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
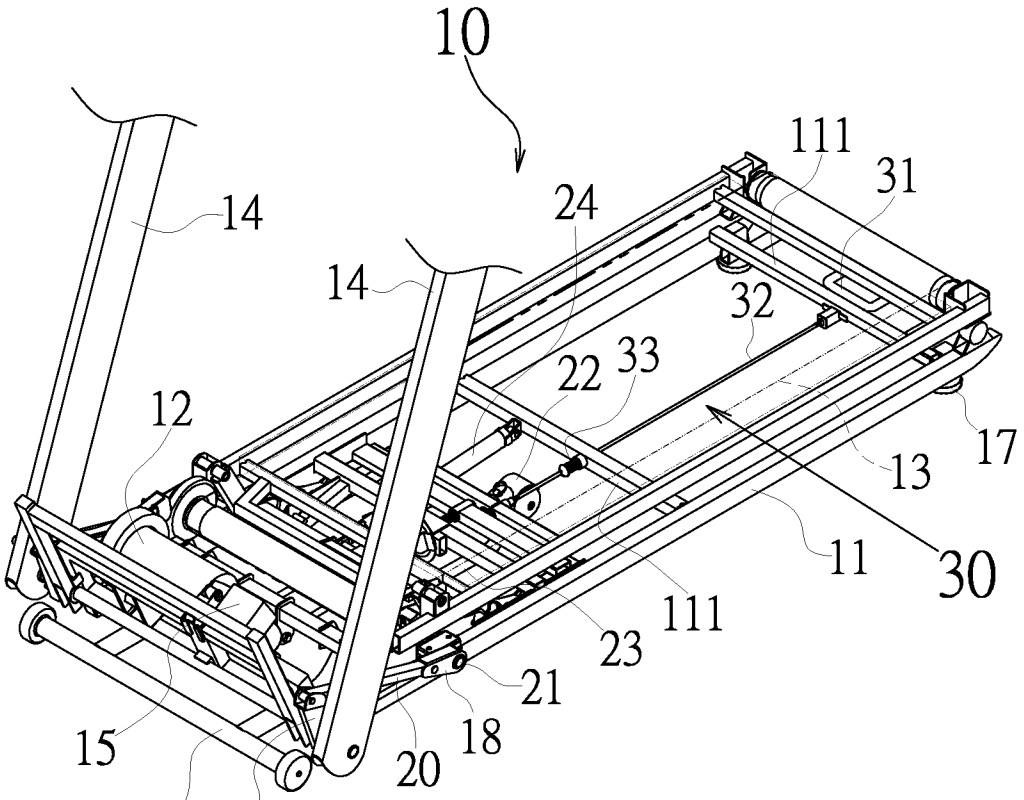
FIG. 1 is a perspective assembly view of the invention.
Figure 2:
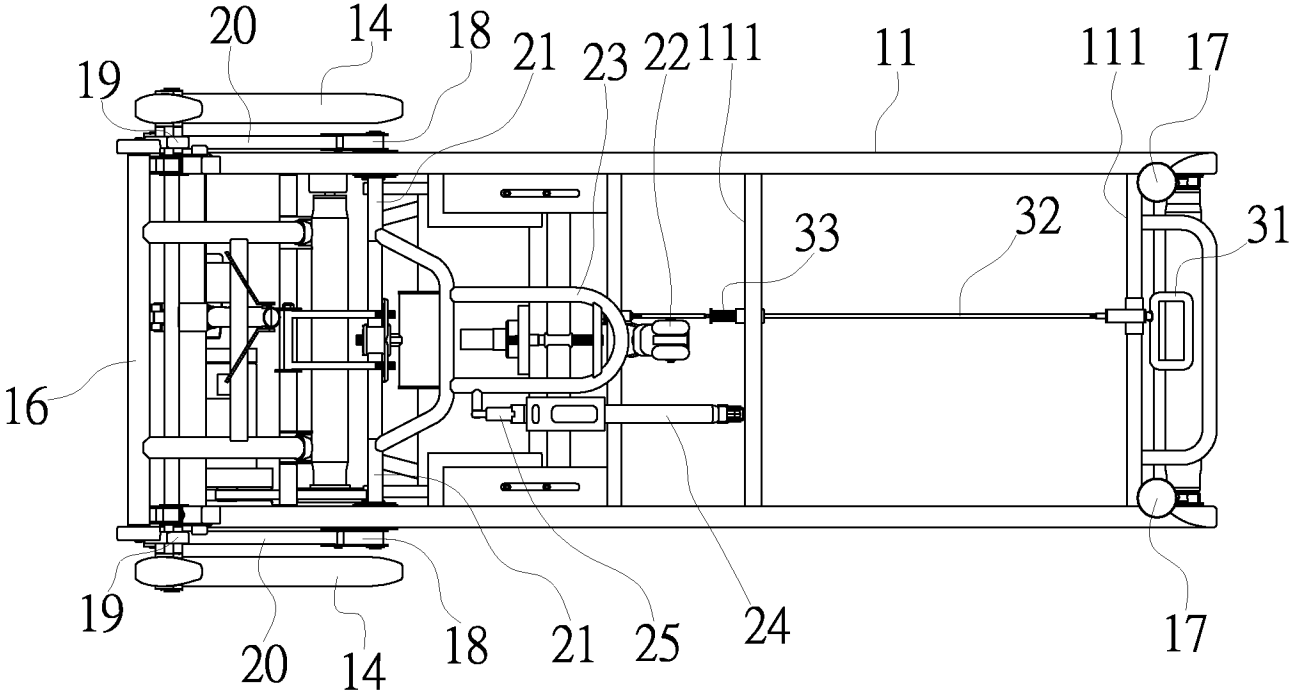
FIG. 2 is a side view of the invention according to FIG. 1.

Referring to FIGS. 1 and 2, a treadmill 10 according to the invention includes a continuous moving belt 13 positioned around a base frame 11 and driven by an electric motor 12. A handrail frame 14 is mounted at both sides of the front end of the base frame 11, respectively. The bottom of the front end of the base frame 21 is provided with a front support frame 16 driven by a lifting motor 15 for adjusting the supporting angle of the base frame 11 that stands for the exercise slope. Moreover, several ground-touching elements 17 are fitted to the bottom of the rear side of the base frame 11.

Figure 4:
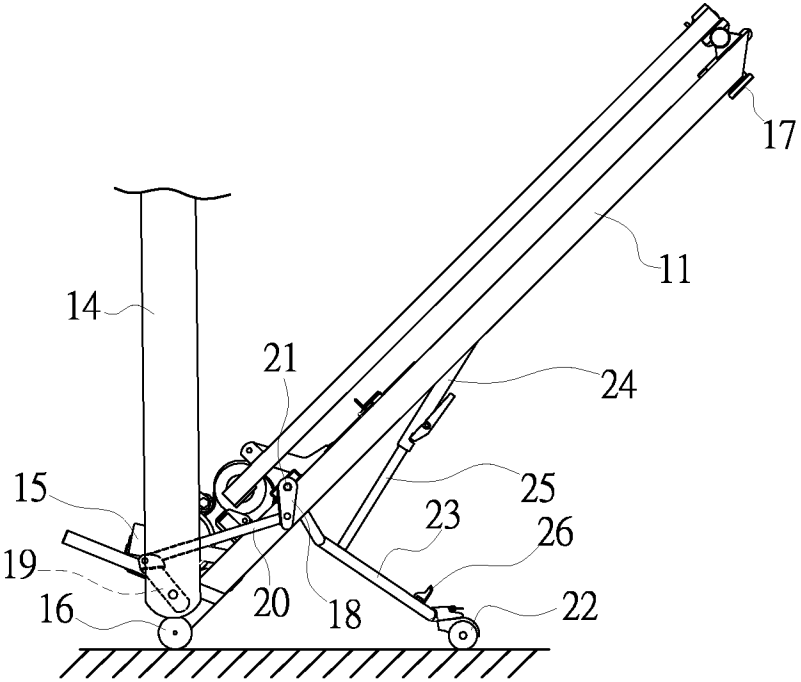
FIG. 4 is a schematic drawing of the operation of the invention according to FIG. 1.
Figure 5:
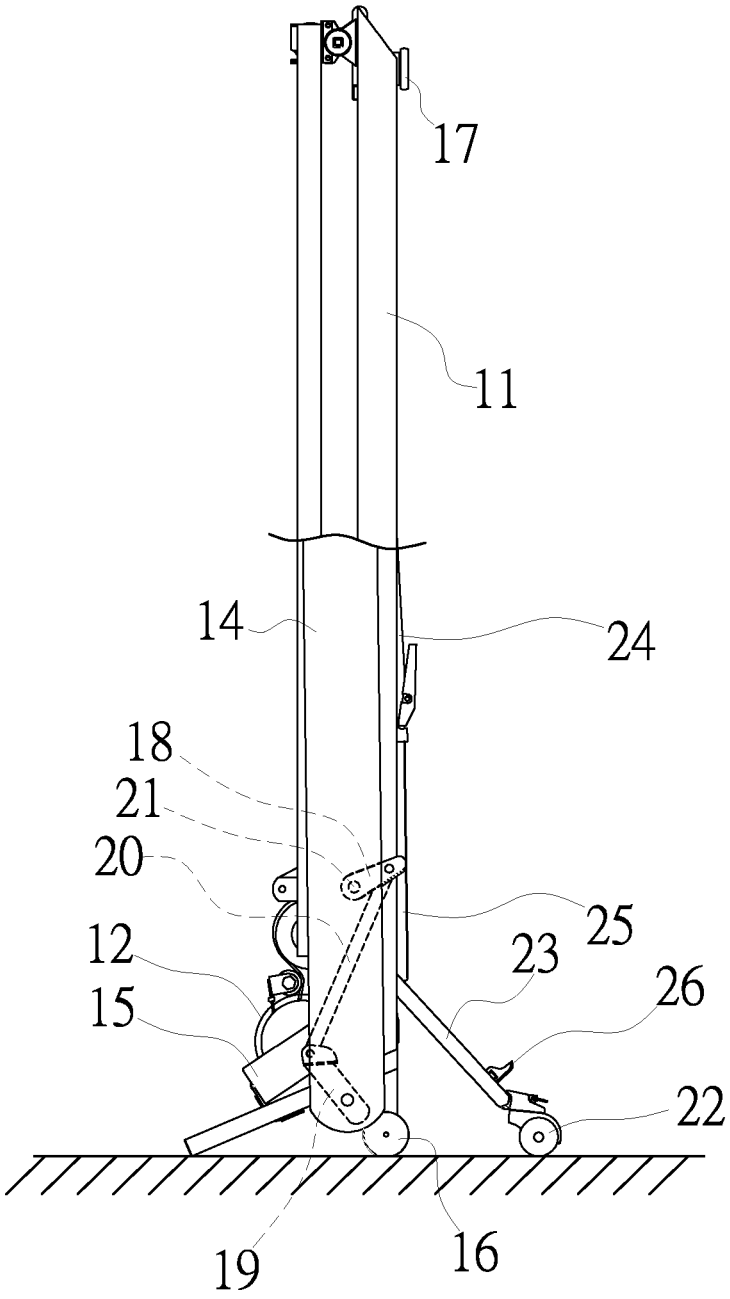
FIG. 5 is a schematic drawing of the invention in a folded-up position.

A base frame swivel piece 18 is pivotally positioned at both sides near the front part of the bottom of the base frame 11, respectively. Meanwhile, a handrail frame swivel piece 19 is pivotally disposed near the bottom of the handrail frames 14, respectively. A pull rod 20 is pivotally interposed between the swivel pieces 18, 19. A movable support 23 with ground-touching rollers 22 is pivotally coupled to a cross shaft 21 of the base frame swivel pieces 18. The movable support 23 is constantly biased by a telescopic supporting element 24. As shown in FIGS. 4 and 5, the action bar 25 of the telescopic supporting element 24 pushes the movable support 23 forward when the base frame 11 is folded upwards in a stable folded-up position. Meanwhile, the ground-touching rollers 22 are constantly in contact with the ground.

Figure 3:
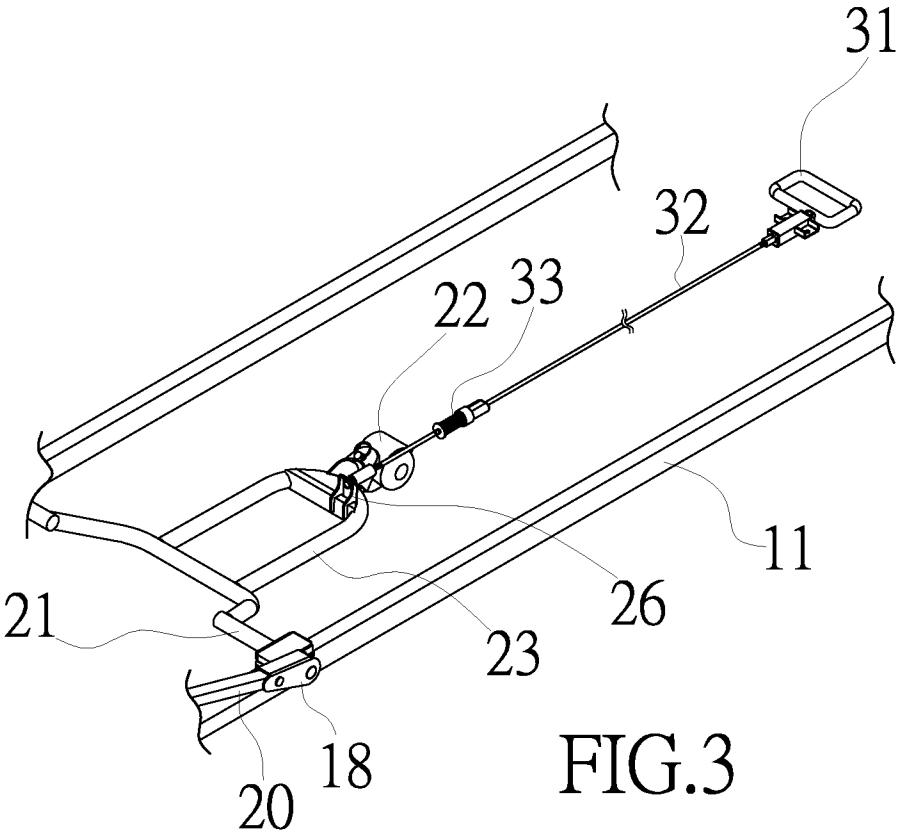
FIG. 3 is a schematic drawing of the movable support and the locking assembly of the invention.

As shown in FIGS. 2 and 3, a locking assembly 30 for locking the movable support 23 in place is positioned at the bottom of the base frame 11. In this way, an unexpected and false folded-up action can be prevented when the base frame 11 lies in a flat position. The locking assembly 30 includes a handle 31, an insertion shaft 32 passing through a cross bar 111 at the bottom of the base frame 11, and an elastic element 33. The insertion shaft 32 fits into a lock element 26 on the movable support 23. In folding-up the base frame 11, the handle 31 has to be pulled to disengage the insertion shaft 32 from the lock element 26 in a release position. In this way, the use safety is ensured.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An electric treadmill with a folding mechanism by use of two types of swivel pieces, the treadmill having a continuous moving belt positioned around a base frame and driven by an electric motor, a handrail frame being mounted at both sides of the front end of the base frame, a bottom of the front end of the base frame being provided with a front support frame driven by a lifting motor, several ground-touching elements being fitted to the bottom of a rear side of the base frame, wherein base frame swivel pieces are pivotally positioned at the both sides of the front end of the base frame near a front part of the bottom of the base frame, respectively;

wherein handrail frame swivel pieces are pivotally disposed near both sides of the bottom of the handrail frames, respectively;

wherein a pull rod is pivotally interposed between each base frame swivel piece and each respective handrail frame swivel piece on each side of the base frame and handrail frame;

wherein a movable support with ground-touching rollers is pivotally coupled to a cross shaft of the base frame swivel pieces; and wherein the movable support is constantly biased by a single telescopic supporting element directly attached to the moveable support.

2. The electric treadmill with a folding mechanism by use of two types of swivel pieces as recited in claim 1, wherein a locking assembly for locking the movable support in place is positioned at the bottom of the base frame, and wherein the locking assembly includes a handle, an insertion shaft passing through a cross bar at the bottom of the base frame, and an elastic element, and wherein the insertion shaft fits into a single lock element on the movable support.

* * * * *